US005540624A

United States Patent [19]

Hixson

[11] Patent Number: 5,540,624

[45] Date of Patent: Jul. 30, 1996

[54] APPROACH SECTION FOR A BOWLING ALLEY

[75] Inventor: Kenneth L. Hixson, Mechanicsville, Va.

[73] Assignee: AMF Bowling, Inc., Mechanicsville, Va.

[21] Appl. No.: 450,317

[22] Filed: May 25, 1995

[51] Int. Cl.[6] ..... A63D 1/04

[52] U.S. Cl. ..... 473/115; 473/117

[58] Field of Search ..... 473/115, 116, 473/117

[56] References Cited

U.S. PATENT DOCUMENTS 4,406,456 9/1983 Berry et al. ..... 473/117

4,421,309 12/1983 Heddon ..... 473/115

*Primary Examiner*—Vincent Millin

*Assistant Examiner*—William M. Pierce

*Attorney, Agent, or Firm*—Bacon & Thomas

[57] ABSTRACT

A bowling alley approach section includes a pair of horizontally disposed rectangular panels which are wider than the width of a corresponding lane section. A first of the panels which is adjacent to and abutting the lane section were separated therefrom by a foul line covers an area where a bowler slides in delivering a bowling ball to the lane section of the alley. The first panel is asymmetrical along its longitudinal axis and symmetrical along its transverse axis and includes a graphic representation on its upper surface. A second generally rectangular synthetic panel is aligned with the first panel and abuts the first panel and is aligned along its longitudinal and transverse axis. The panels are supported in a common horizonal plane.

6 Claims, 2 Drawing Sheets

APPROACH SECTION FOR A BOWLING ALLEY

FIELD OF THE INVENTION

This invention relates to a novel construction for an approach section of a bowling alley and more particularly to an oversized synthetic panel assembly wherein each of a plurality of panels are symmetrical along a first axis and asymmetric along a second or transverse axis.

BACKGROUND FOR THE INVENTION

For many years, bowling alleys have been constructed of transversely laminated longitudinally extended woodstrips having a urethane coated surface. These woodstrips are of random lengths and are secured to each other by mechanical fasteners such as nails or adhesives. The approach section of the alley is made of relatively hard maple and terminates in a splice with one of several relatively soft pine sections. The pine or lane sections terminate in a high impact abrasion resistant pin deck.

A more recent approach to bowling alley construction uses a high pressure laminate material as a replacement for wood, particularly in areas of high wear such as the approach and pin deck sections of an alley. Such laminates typically include an external or upper surface with the appearance of wood. Laminates are adhesively bonded to a wooden base in resurfacing an existing lane or to a high density particle board in constructing a new alley.

There are several problems associated with the use of a high pressure laminate in the approach section of a bowling alley. For example, in a typical bowling center with a plurality of side-by-side alleys, the spaces between adjacent bowling lanes varies due to the ball returns which are placed between every other lane and a next adjacent lane. As a result, the spacing between two adjacent lanes, i.e., a common (without a ball return) is about 21 inches to allow for a pair of gutters while the spaces between lanes having a ball return therebetween is about 28 inches.

The approach section also includes graphics which are necessarily aligned with comparable graphics on each bowling lane. For example, each bowling lane includes seven dots, a ¾ inch dot in the center of a lane with three ½ inch dots spaced across the lane on each side thereof. The approach section which is separated from the lane section by a foul line also includes the same seven dot configuration which are aligned with the dots on the lane section and spaced from the foul line at the same distance as the dots on the lane section. For this reason, an attempt to manufacture a single one piece panel to cover the approach section would require a left and a right panel, i.e., different sized panels to cover the approach section next to a ball return and those next to adjacent alleys without a ball return.

Accordingly, the approach section is typically made up of a plurality of panels. For example, a first panel is typically rectangular in shape, 12 feet long by 41⅞ inches wide so that its width is equal to the width of the bowling lane and one end of its length is abutting the foul line and/or bowling lane. This first panel also includes a graphic representation on its upper surface which corresponds to the graphic representation, i.e., wood grain, on an adjacent lane section. The typical approach section also includes a second panel which is about 6 feet in length by 41 and ⅞ inches width which also includes a graphic representation thereon and which is placed in an end-to-end abutting relationship with the first panel. Each of the panels includes the same graphic representation, i.e., wood grain on its surface.

In addition to the two relatively large panels, a narrow panel of about 21 inches and one of about 28 inches are used to fill the space between adjacent lanes. In normal installations, each of the narrow panels are made up of two end-to-end panels to accommodate the approximately 15–18 foot length of the approach section.

Notwithstanding the advantages of the high pressure laminate panels, there has been some resistance to their acceptance. The resistance is based on a need for a smooth surface between the forward panel and the relatively narrow panel on each side thereof. The problem is that bowlers frequently slide across the area where the panels interface or at the seam. At times, an unevenness develops due to uneven wear and/or slight misalignment due to improper installation. Even a very slight unevenness can cause a bowler's foot to track along the seam, or at times trip or otherwise disrupt a bowler's smooth delivery of the ball to the lane.

It has now been found that an improved approach section construction overcomes many of the problems associated with the prior art. For example, such construction eliminates seams in the area of the bowler's slide as well as any need for a left and right panel. In other words, a single panel can be used for adjacent lanes whether or not they are separated by a ball return. The construction also facilitates manufacturing and installation since a single panel can be used for either of the two adjacent lanes whether or not there is a ball return between the lanes.

In describing the invention, the term "bowling center" refers to an establishment that includes a plurality of side-by-side bowling alleys. "Bowling alleys" refer to the individual alleys which include an approach section, a lane section and a pin deck section as well as a gutter on each side of the bowling lane. A "bowling lane" refers to the portion of the alley between the approach section and the pin deck and between the two gutters.

BRIEF SUMMARY OF THE INVENTION

In essence, the present invention contemplates a novel construction for a bowling center of the type having a plurality of side-by-side bowling alleys. Each of the alleys includes an approach section, a lane section with a gutter on each side thereof and with a ball return between every other lane and a next adjacent lane. The invention is directed to the approach sections whereon a bowler takes several steps and then slides toward the lane section and foul line before releasing a bowling ball.

The construction includes a pair of generally rectangular synthetic panels each of which has longitudinal and transverse axes and a third axis which is perpendicular to the other two axes. In a preferred embodiment of the invention, the panels lie in a horizontal plane and the third axis is a vertical axis. A first of the panels has a length which is greater than its width and a width which is greater than the width of the bowling lane. This first panel is disposed in a forward position of the approach section with one of its ends abutting the foul line and/or bowling lane. The panel also includes an upper surface and a graphic representation which is asymmetrical along the longitudinal axis and symmetrical with respect to its transverse axis. This graphic representation covers the upper surface of the panel. The first panel may be rotated 180° in either direction about its third axis and used in the forward portion of the approach section of an adjacent lane.

A second of the panels has a width which is wider than the width of a bowling lane and which is essentially identical to the width of the first panel. The second panel also includes or defines an upper surface and has a graphic representation thereon. The graphic representation which completely covers the second panel is asymmetrical along its longitudinal axis. It is also asymmetric with respect to its transverse axis in most installations.

The second panel, as manufactured, is symmetrical along its transverse axis. But one end thereof will normally be cut off to fit a particular installation. For this reason, the second panel will be asymmetrical in the final installation. The second panel in its original form may also be rotated 180° about its third axis and used as a portion of the approach section in an adjacent lane.

As contemplated by the invention, means such as a particle board base support the panel in a common plane and in an end-to-end abutting relationship so that the graphic representation such as a plurality of wood strips on the second panel is a continuation of the representation on the first panel.

The invention also contemplates a novel method for constructing approach sections for a plurality of side-by-side bowling lanes wherein each of the lanes has a gutter on each side thereof and wherein a ball return is disposed between every other lane. The method includes the step of providing a relatively flat base or support in an approach section of a bowling alley adjacent to the lane section. The base or support may, for example, comprise a high density particle board or an earlier approach section which has been sanded down by a sufficient amount about ½ inch or more to accommodate a plurality of high pressure laminated panels.

The method in accordance with the present invention also includes the step of providing a pair of generally rectangular horizontally disposed synthetic panels, each of which has longitudinal, traverse and vertical axes. A first of these panels has a length which is greater than its width and a width which is greater than the width of a bowling lane. The first panel is asymmetrical along the longitudinal axis thereof and symmetrical along its transverse axis and includes an upper surface with a graphic representation thereon.

The second horizontally disposed generally rectangular synthetic panel is aligned with the longitudinal axis of the first panel while its transverse and third axes are displaced from but parallel to the transverse and vertical axis of the first panel when the second panel is abutting the first panel in an end-to-end relationship. The second panel also includes a graphic representation which is asymmetrical along its longitudinal axis and acts as a continuation of the graphical representation of the first panel.

As contemplated by the preferred embodiment of the invention, the method includes the step of supporting the panels in a common plane and an end-to-end abutting relationship so that the graphic representation on the second panel is a continuation of the graphic representation on the first panel and with the panels providing a smooth unobstructed surface over the area of a bowlet's slide. In addition, the method includes the step of cutting the end portion of the second panels off to accommodate or to fit the actual length of the approach section and the step of inserting a separate panel between those panels having a ball return therebetween.

DESCRIPTION OF THE DRAWINGS

The invention will now be described in connection with the accompanying drawings wherein like reference numerals have been used to designate like features.

DETAILED DESCRIPTION OF THE PREFERRED EMBODIMENTS OF THE INVENTION

Figure 1:
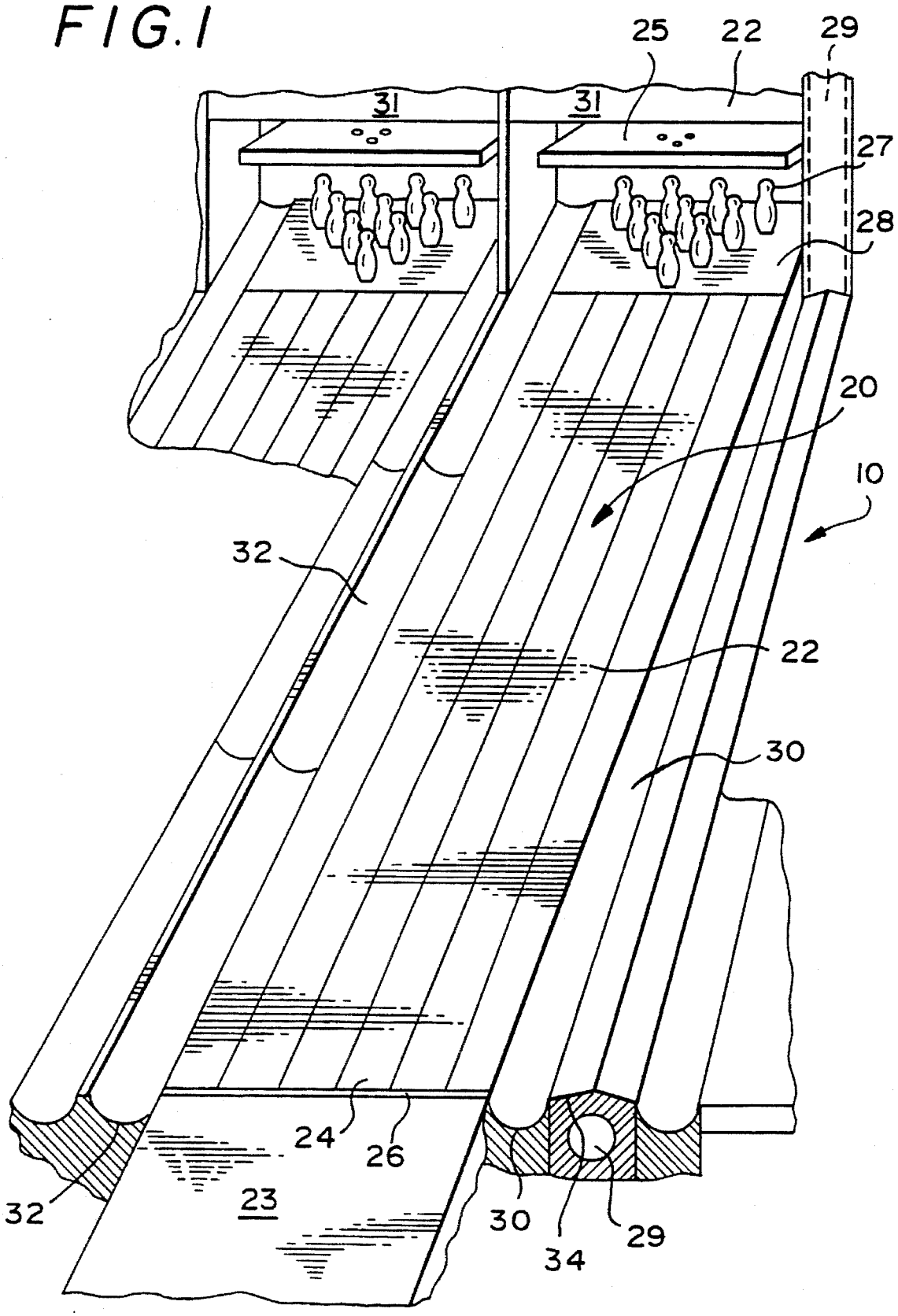
FIG. 1 is a perspective view illustrating a plurality of side-by-side bowling alleys.

The invention will now be described in connection with the accompanying drawings wherein like reference numerals have been used to designate like parts.

As illustrated in FIG. 1, a bowling alley 10 typically includes a longitudinally extending lane 20 which defines a flat horizontal plane on an upper surface thereof and which is typically made up of a plurality of parallel abutting strips of wood 22, 24. In many of today's installations, the abutting strips have been replaced by a laminated panel. The alley includes a foul line 26 which extends across the lane 20 and perpendicular to the longitudinal axis of the lane. The foul line 26 indicates that area beyond which a bowler may not pass in releasing a bowling ball during a game of bowling. The area in front of the foul line is referred to as the approach section 23. A pin deck 28 is disposed at the opposite end of the lane 20 and is adapted to receive a plurality of bowling pins 27 thereon. As shown, the bowling alley is set with the pins in a customary triangular pattern with one pin, the head pin in front, a second row of two pins, a third row with three pins and a final of four pins. A pin spotting mechanism or pin spotter 25 is disposed above the pin deck 28 in a customary manner.

A pair of longitudinally extending gutters 30, 32 are disposed along the side of the lane 20 with one gutter on each side of lane 20 in a customary manner, i.e., adjacent to and in substantially abutting relationship with the lane. The gutters 30, 32 are adapted to receive any balls that are bowled toward one side of the lane and to direct any misdirected balls to the end of the alley. Also illustrated are capping member 34 which separates two adjacent alleys.

A conventional pin spotter or unit 25 (shown schematically) may be of any suitable design. One such design is disclosed in the U.S. Pat. No. 3,807,732, of Congelli, which is incorporated herein in its entirety by reference. A more recent example of a suitable pin spotting mechanism is the AMF model 82-90 which is available from AMF Bowling, Inc. of Mechanicsville, Va. The bowling alley also includes a conventional ball return 29 (shown schematically). The ball return may, for example, take the form shown in the U.S. Pat. No. 5,076,582 of Edwards, entitled "Bowling Ball Lifting Apparatus". That patent is assigned to the same assignee as the present application and is incorporated herein in its entirety by reference. A masking unit 31 is also shown schematically in FIG. 1 in a position which is generally above its normal position in order to illustrate the forward portion of the pin spotter 25.

Figure 2:
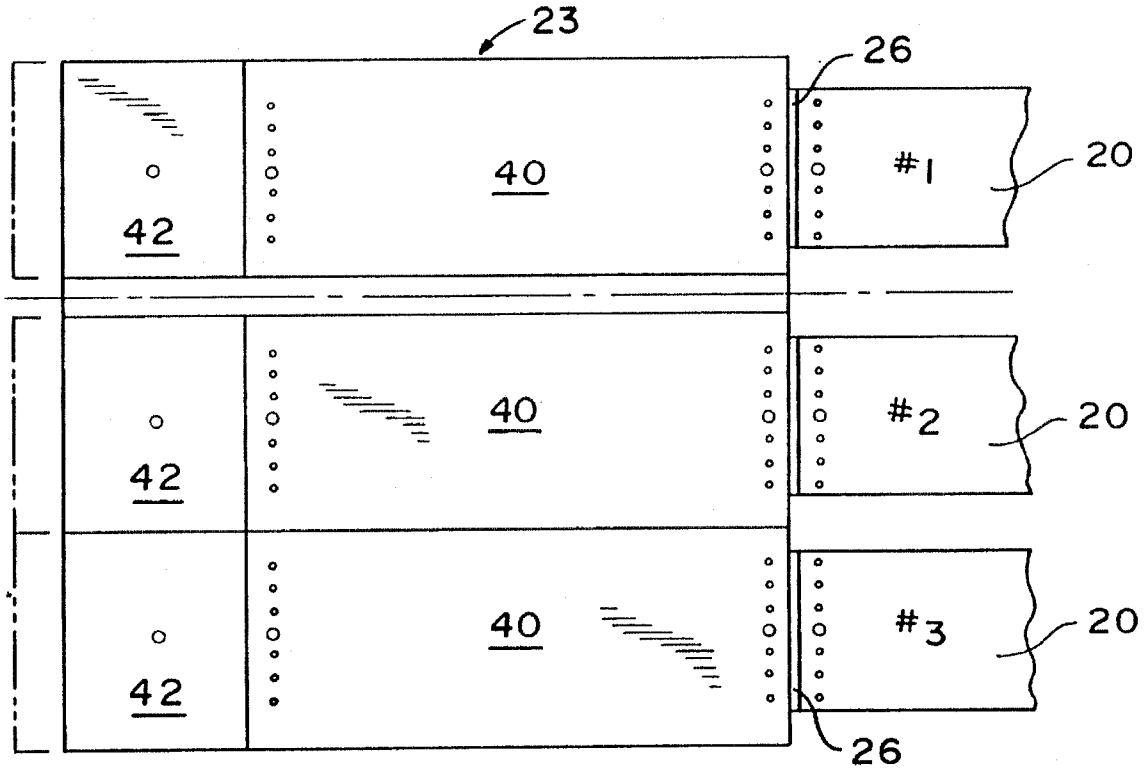
FIG. 2 is a top or plan view of a plurality of side-by-side bowling alleys including an approach section in accordance with the present invention.

As shown more clearly in FIG. 2, a plurality of bowling lanes 20 or lane sections are disposed in side-by-side relationship wherein lane #1 and lane #2 are separated by a pair of gutters (not shown). The lanes each include a gutter on each side thereof so that two gutters separate each of the bowling lanes from an adjacent lane. However, the space in between lane #1 and lane #2 is greater than the space between lane #2 and lane #3 in order to accommodate a ball return which is disposed thereunder, i.e., below the lane surface and gutter. With respect to the spacing between lane #2 and lane #3, the two gutters which separate the lanes are essentially abutting so that there is little or no space therebetween.

Each of the bowling lanes 20 includes a graphic design on the upper surface thereof. For example, the rules of the American Bowling Congress call for a series of seven dots which are transversely arranged across the 41 and ⅞ inches width of the lanes at a distance of 3 and ½ inches from the foul line.

A second series of seven dots are also disposed on the approach section at a distance of 2 and ⅜ inches from the foul line and aligned with the dots on the lane.

A layout for a plurality of side-by-side bowling alleys which incorporate an approach section in accordance with a preferred embodiment of the present invention is shown in FIG. 2. As shown therein, the approach section includes a pair of rectangular synthetic panels 40 and 42. The first panel 40 is approximately 12 feet long and has a width of 5 feet. The second panel has a length of about 6 feet and a width of 5 feet. Each of the panels 40 and 42 comprises a high pressure laminate with suitable graphics on an upper surface thereof. An example of a suitable material is the HPL material which is available from AMF Bowling, Inc. of Mechanicsville, Va.

The panel 40 is positioned adjacent to and abutting foul line 26 and includes a series of seven dots on its top surface at each end thereof. The center dot which is ¾ inches in diameter is then aligned with a center dot which is in the center of each lane at a distance of 2 and ⅜ inches from the foul line taken from the center of the dot to the edge of the foul line. The remaining six dots which are ½ inches in diameter are arranged in a straight line across panel 40 so that they are aligned with the corresponding dots in the lane section on the alley.

In the preferred embodiment of the invention, the graphic display is symmetrical in a first direction and asymmetrical in a second direction. For example, there is a dot display at each end of panel 40 at the same distance from an adjacent edge. For example, for each line of dots, i.e., the distance from a line passing through the center of the dots should be 2 and ⅜ inches from an adjacent edge. However, the distance from a line drawn through the so-called center dots, that is those aligned with the center of the lane section to each side and extending longitudinally are different to accommodate for the ball return in alternate alleys. To be more specific, the distance from the line drawn between the two "center" dots to a first line is about 28 and ½ inches, while the distance to the second side is about 31 and ½ inches.

In constructing a plurality of alleys, the so-called short sides, i.e., the sides which are 28 and ½ inches from the center of a lane, abut one another between those alleys which are not spaced apart to accommodate a ball return. The opposite sides, i.e., those which are 31 and ½ inches from the so-called "center line" (an extension of the center of the lane section) do not abut one another, but are separated by a filler strip 43 which makes up for the extra spacing for a ball return.

Thus, it should be clear that an approach section construction in accordance with the present invention provides a number of advantages over a conventional construction. First, there is little or no likelihood that a bowler will slide across a joint or seam in making an approach to the lane section. Second, a single filler strip of uniform size is used between alternate alleys as opposed to having two filler strips of different widths with one on each side of an alley. And finally, there is no need to manufacture left and right panels since a single panel can be rotated 180° about its vertical axis for use in the next adjacent lane.

The second rectangular panel 42 has a length of about 6 feet, a width of about 5 feet and like panel 40, is preferably symmetrical in a first direction and asymmetrical in a second direction at the time of manufacture and shipping. The second panel 42 includes a center dot on a top surface thereof. This center dot is preferably 2 feet, 9 and ⅝ inches from its forward and trailing edge and is aligned with the center dot on panel 40. Therefore, when panel 42 is in abutting relationship to panel 40, the dot on panel 42 is 28 and ½ inches from one side and 31 and ½ inches from the opposite side.

It should be recognized that the approach section for the bowling alleys vary from one bowling center to another. These sections are, for example, from 15 feet to 18 feet. For this reason, one end of panel 42 is trimmed, i.e., cut to fit the particular alley. For example, the portion of panel 42 shown in dotted lines may be removed during installation.

Figure 3:
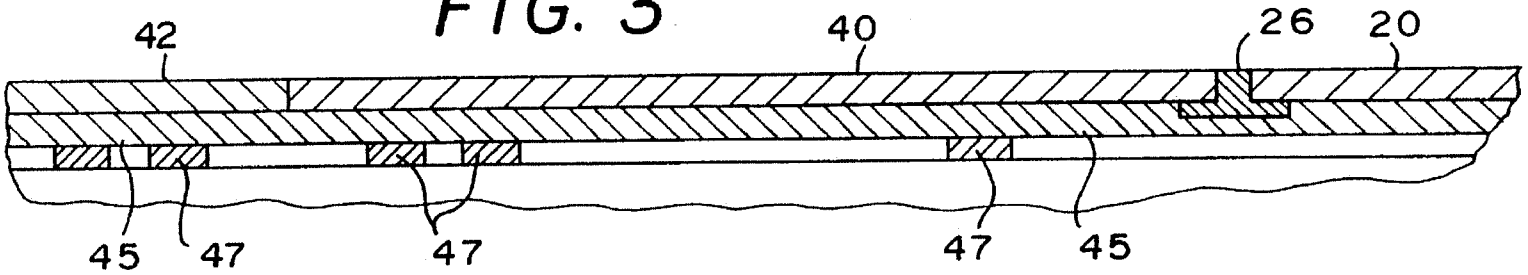
FIG. 3 is a cross-sectional view of the bowling alley approach section shown in FIG. 2.

FIG. 3 is a cross-sectional view which shows panels 40 and 42 which are supported by a particle board base support 45 and a plurality of cross supports 47. An adjacent foul line 26 and lane section 20 are also shown.

While the invention has been described in connection with its preferred embodiments, it should be recognized that changes and modifications may be made therein without departing from the scope of the appended claims.

What is claimed is:

1. In a bowling center of the type having a plurality of side-by-side bowling alleys each of which include an approach section, a lane section and a foul line separating said approach section and said lane section and with a gutter on each side of each of said alleys, and with a ball return between every other adjacent lane, the improvement comprising an approach section which includes:

(a) a first generally rectangular synthetic panel having a generally horizontal longitudinal axis which is generally parallel with the lane section of the alley, a generally horizontal transverse axis which is generally parallel to the foul line and a third axis which is perpendicular to said longitudinal and transverse axes, said panel having a length which is greater than its width and a width which is greater than the width of a bowling lane, said panel including a graphic representation on an upper surface thereof and said graphic representation being asymmetrical along said longitudinal axis and symmetrical along its transverse axis;

(b) a second generally rectangular synthetic panel having longitudinal and transverse axes and a third axis which is perpendicular to said longitudinal and transverse axes and with its longitudinal axis aligned with said longitudinal axes of said first panel while its transverse and third axes are displaced from but parallel to said transverse and third axes of said first panel when said second panel is abutting said first panel, said second panel including a graphic representation on an upper surface thereof and with said graphic representation being asymmetrical along its longitudinal axis; and (c) means supporting said panels in a common plane in an end-to-end abutting relationship so that said graphic representation on said second panel is a continuation of said graphic representation on said first panel and wherein said first panel if rotated 180° about its third axis in either direction being identical to a comparable panel in a next adjacent lane.

2. In a bowling center in accordance with claim 1 wherein each of said panels have an identical width.

3. In a bowling center in accordance with claim 2 wherein the third axis of each of said panels is vertical and wherein the adjacent and abutting panels provide a smooth horizontal surface.

4. In a bowling center in accordance with claim 3 in which the graphic representation on the upper surface of said second panel is asymmetric with respect to its transverse axis.

5. In a bowling center in accordance with claim 4 which includes a separate, relatively narrow panel over a ball return portion of the alley.

6. A method for constructing an approach section for a plurality of side-by-side bowling lanes wherein each of the lanes has a gutter on each side thereof and wherein a ball return is disposed between every other lane, the method comprising:

(a) providing a first generally rectangular synthetic panel having a generally horizontal longitudinal axis which is generally parallel with the lane section of the alley and transverse axis, a third axis which is perpendicular to said longitudinal and transverse axes, said panel having a length which is greater than its width and a width which is greater than the width of a bowling lane, said panel also including an upper surface and a graphic representation which is asymmetrical along said longitudinal axis and symmetrical along its transverse axis covering said upper surface;

(b) a second generally rectangular synthetic panel having longitudinal and transverse axes and a third axis which is perpendicular to said longitudinal and transverse axes and with its longitudinal axis aligned with said longitudinal axes of said first panel while its transverse and third axes are displaced from but parallel to said transverse and third axes of said first panel when said second panel is abutting said first panel, said second panel including an upper surface and a graphic representation which is asymmetrical along its longitudinal axis covering its upper surface; and (c) supporting said panels in a common horizontal plane in an end-to end abutting relationship so that the graphic representation on the second panel is a continuation of the graphic representation on the first panel and wherein the first panel if rotated 180° about its third axis in either direction being identical to a comparable panel in a next adjacent lane.

* * * * *